US010203102B2

(12) United States Patent
Wertz et al.

(10) Patent No.: US 10,203,102 B2
(45) Date of Patent: Feb. 12, 2019

(54) LED MODULE WITH LIQUID COOLED REFLECTOR

(71) Applicant: Air Motion Systems, Inc., River Falls, WI (US)

(72) Inventors: Jared J. Wertz, River Falls, WI (US); Michael D. Callaghan, Minneapolis, MN (US); Matthew R. Hauser, New Richmond, WI (US)

(73) Assignee: Air Motion Systems, Inc., River Falls, WI (US)

( * ) Notice: Subject to any disclaimer, the term of this patent is extended or adjusted under 35 U.S.C. 154(b) by 82 days.

(21) Appl. No.: 15/289,060

(22) Filed: Oct. 7, 2016

(65) Prior Publication Data

US 2017/0102138 A1 Apr. 13, 2017

Related U.S. Application Data

(60) Provisional application No. 62/238,933, filed on Oct. 8, 2015.

(51) Int. Cl.
*F21V 29/00* (2015.01)
*F21V 29/56* (2015.01)
(Continued)

(52) U.S. Cl.
CPC ..... *F21V 29/56* (2015.01); *B41F 23/0409* (2013.01); *B41F 23/0453* (2013.01);
(Continued)

(58) Field of Classification Search
CPC ... B41F 23/0409; B41J 11/002; F21V 15/015; F21V 23/06; F21V 29/504; F21V 29/56; F21V 3/02; F21V 7/005; F21Y 2115/10
See application file for complete search history.

(56) References Cited

U.S. PATENT DOCUMENTS 5,071,340 A 12/1991 Labianca
8,641,236 B2 2/2014 Martinez et al.
(Continued)

FOREIGN PATENT DOCUMENTS

WO 2015094086 A1 6/2015

OTHER PUBLICATIONS

The International Search Report and Written Opinion rendered by the International Searching Authority for PCT/US2016/056163, dated Dec. 23, 2016, 11 pages.
(Continued)

*Primary Examiner* — Tsion Tumebo
(74) *Attorney, Agent, or Firm* — Skaar Ulbrich Macari, P.A.

(57) ABSTRACT

A light emitting diode (LED) module includes a first end cap, a second end cap and a reflector portion. The reflector portion extends longitudinally between the first end cap and the second end cap. The reflector portion includes a coolant passageway defined longitudinally through the reflector portion and is fluidically coupled to the first end cap and the second end cap. An LED package is disposed adjacent to the reflector portion. An orifice bushing can be disposed within a coolant passage defined in the first end cap to restrict coolant flow through the reflector portion to preclude starvation of coolant flow elsewhere in the LED module.

20 Claims, 2 Drawing Sheets

(51) Int. Cl.

| | |
|---|---|
| ***F21V 29/504*** | (2015.01) |
| ***F21V 3/02*** | (2006.01) |
| ***F21V 7/00*** | (2006.01) |
| ***F21V 15/015*** | (2006.01) |
| ***F21V 23/06*** | (2006.01) |
| ***B41J 11/00*** | (2006.01) |
| ***B41F 23/04*** | (2006.01) |
| *F21Y 115/10* | (2016.01) |

(52) U.S. Cl.
CPC ..... *B41J 11/002* (2013.01); *F21V 3/02* (2013.01); *F21V 7/005* (2013.01); *F21V 15/015* (2013.01); *F21V 23/06* (2013.01); *F21V 29/504* (2015.01); *F21Y 2115/10* (2016.08)

(56) References Cited

U.S. PATENT DOCUMENTS

| | | | | |
|---|---|---|---|---|
| 2002/0118541 | A1* | 8/2002 | Stowell | B05D 3/067 362/294 |
| 2008/0143806 | A1 | 6/2008 | Claeys | |
| 2012/0162976 | A1* | 6/2012 | Claeys | B41F 23/0409 362/218 |

OTHER PUBLICATIONS

Bahde, Dr. Keith, Thermal Management for LED Luminaires, LED Professional, <https://www.led-professional.com/downloads/LpR_04_free_23761_pdf>, Nov./Dec. 2007, retrieved Nov. 25, 2016, p. 9-12.

* cited by examiner

LED MODULE WITH LIQUID COOLED REFLECTOR

PRIORITY

This application claims priority under 35 U.S.C. § 119(e) to, and hereby incorporates by reference in its entirety, U.S. Provisional Application No. 62/238,933, filed Oct. 8, 2015.

FIELD

This invention relates to an apparatus for curing deposited substances on a substrate and, in particular, this invention relates to light emitting diode (LED) modules for curing substances deposited on a substrate by irradiation wherein the LED reflector extrusion includes a fluid cooling passageway.

BACKGROUND

In the printing industry, use of ultra-violet (UV) curable inks and other substances is increasing, due to the increasingly fast curing rates effected by UV radiation. The UV radiation is increasingly being produced by high intensity light emitting diodes (LEDs). Those diodes are provided as part of an LED module such as is disclosed in U.S. Pat. No. 8,641,236, which is hereby incorporated herein in its entirety.

High intensity LED devices generate a considerable amount of energy in two different ways. The first type of energy is in the form of heat. The second form of energy is in the form of light. The light contains energy that is absorbed by the optical focusing reflector, the absorbed energy is converted into heat. Thus, high intensity LED devices such as those used to produce UV radiation present great challenges in designing thermal energy management, optical energy management, and electrical energy management (interconnection). This is a particular problem in designing LED light-emitting systems that must focus high levels of specific wavelength light at relatively short distances, such as 10 mm-100 mm. These designs require high density packaging (mounting) of the LED devices, and therefore generate a large quantity of heat. Heat buildup can damage the LED elements and other circuitry. Heat buildup can also make the LED module's housing too hot to safely handle and result in injury if touched. Additionally, high temperatures may cause reflectors to warp and adjacent structures, such as the LED package, to warp and degrade. There is a continuing need to provide improved LED modules for high intensity UV curing systems.

SUMMARY

The disclosure includes a light emitting diode (LED) module including a first end cap, a second end cap and a reflector portion. The reflector portion extends longitudinally between the first end cap and the second end cap. The reflector portion includes a coolant passageway defined longitudinally through the reflector portion and is fluidically coupled to the first end cap and the second end cap. An LED package is disposed adjacent to the reflector portion. An orifice bushing can be disposed within a coolant passage defined in the first end cap to restrict coolant flow through the reflector portion to preclude starvation of coolant flow elsewhere in the LED module.

The reflector portion can include an inner curved surface oriented to reflect radiation emitted by the LED package so that the radiation exits the LED module laterally from the LED module between the first and second end caps.

A side cover portion can be coupled to the reflector portion to define an enclosure having an interior and a longitudinal opening spanning laterally between a portion of the reflector portion and a portion of the side cover portion. A transparent cover portion can be disposed in the longitudinal opening to form a sealed enclosure, and wherein the LED package is disposed entirely within the enclosure.

A heat exchanger can be thermally coupled to the LED package and extend longitudinally between the first and second end caps. The heat exchanger can include at least one coolant passageway defined through a longitudinal length of the heat exchanger.

The first end cap can include a first fluid passage, a second fluid passage, a third fluid passageway, and an orifice bushing disposed within the third fluid passageway. The orifice bushing defines a narrowed inner diameter portion of the third fluid passageway. The third fluid passageway communicates with the second fluid passageway and not the first fluid passageway. The first, second and third fluid passageways can be defined within an insulated block arranged to float within a cavity defined in the first end cap. An O-ring can be disposed between the orifice bushing and a sidewall of the cavity defined in the first end cap.

A second end cap can be coupled to the LED module that has a mirror image configuration about an axis normal to the longitudinal length of the reflector portion as compared to the first end cap.

The disclosure further includes an end cap for a liquid cooled LED module. The end cap can include a first fluid passageway, a second fluid passageway, a third fluid passageway and an orifice bushing disposed within the third fluid passage to define a narrowed inner diameter portion of the third fluid passageway. The third fluid passageway communicates with the second fluid passageway and not the first fluid passageway.

The first, second and third fluid passageways can be defined within an insulated block arranged to float within a cavity defined in the first end cap. An O-ring can be disposed between the orifice bushing and a sidewall of the cavity defined in the first end cap. A coolant inlet can extend longitudinally from the end cap and communicate with the first fluid passage, but not communicate with the second fluid passage and the third fluid passage. A coolant outlet can extend longitudinally from the end cap and communicate with the second fluid passage and the third fluid passage, but not communicate with the first fluid passage.

The disclosure additionally includes a method of cooling an LED package disposed in an LED module. The method includes circulating a coolant through a passageway defined within a reflector portion of the LED module, circulating the coolant fluid through a first passageway defined within a heat exchanger thermally coupled to the LED package, and restricting the flow of coolant circulating through the passageway defined within the reflector portion of the LED module to prevent starving of the flow of coolant circulating through the first passageway defined within the heat exchanger.

The restriction can be provided by disposing an orifice bushing within a passageway defined in an end cap.

The coolant fluid can be circulated through a second passageway defined within a heat exchanger thermally coupled to the LED package in an opposite direction as the circulation of the coolant fluid through the passageway defined within a reflector portion of the LED module.

An end cap can be disposed over an end of the reflector portion. The fluid circulating through the passageway defined within the reflector portion of the LED module can be combined with the coolant fluid circulating through the first passageway defined within the heat exchanger. The coolant fluid circulating through a first passageway defined within a heat exchanger can be isolated from the fluid circulating through the passageway defined within the reflector portion of the LED module and from the coolant fluid circulating through the first passageway defined within the heat exchanger. The steady state operating temperature of a reflector portion of the LED module can be lowered to be within a range of 70° F. and 80° F.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
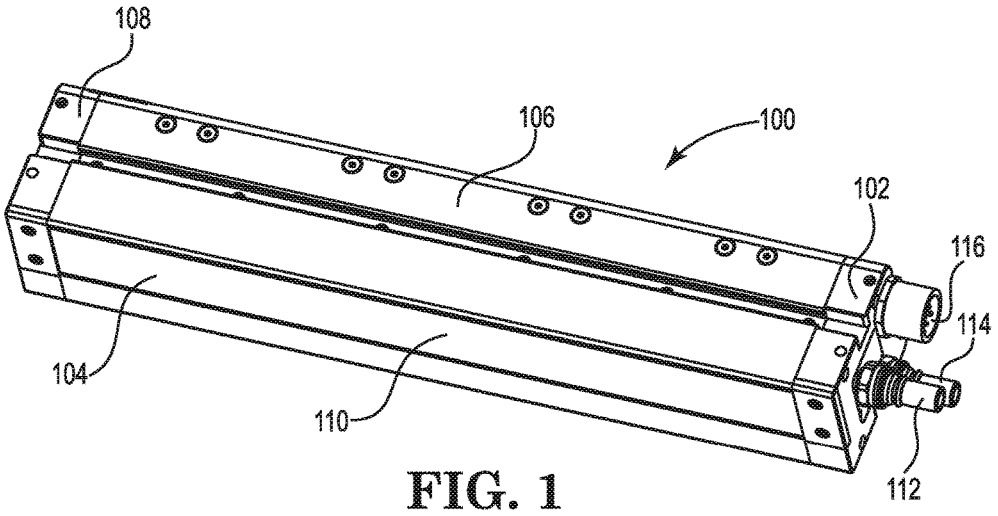
FIG. 1 is a perspective view of an LED module according to certain example embodiments.

It is understood that the above-described figures are only illustrative of the present invention and are not contemplated to limit the scope thereof.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

Individual LED elements are arranged in an assembly which is called a package. The complete assembly is referred to as an LED package. The LED package is disposed in a housing that manages (contains) the electrical connections and the cooling capabilities. The complete housing with LED package is referred to as an LED module. The light emitted by the LED module can be used for processing chemicals and solutions. For example the light can be used for polymerizing UV-sensitive ink during printing. The processing of different chemicals and solutions requires different focusing fixtures.

Figure 2:
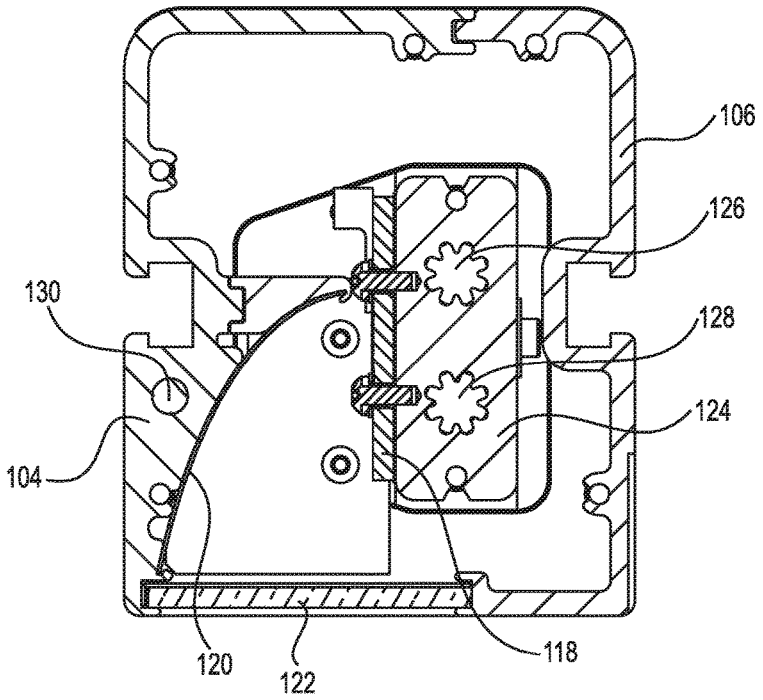
FIG. 2 is a cross sectional view of an LED module according to certain embodiments.
Figure 3:
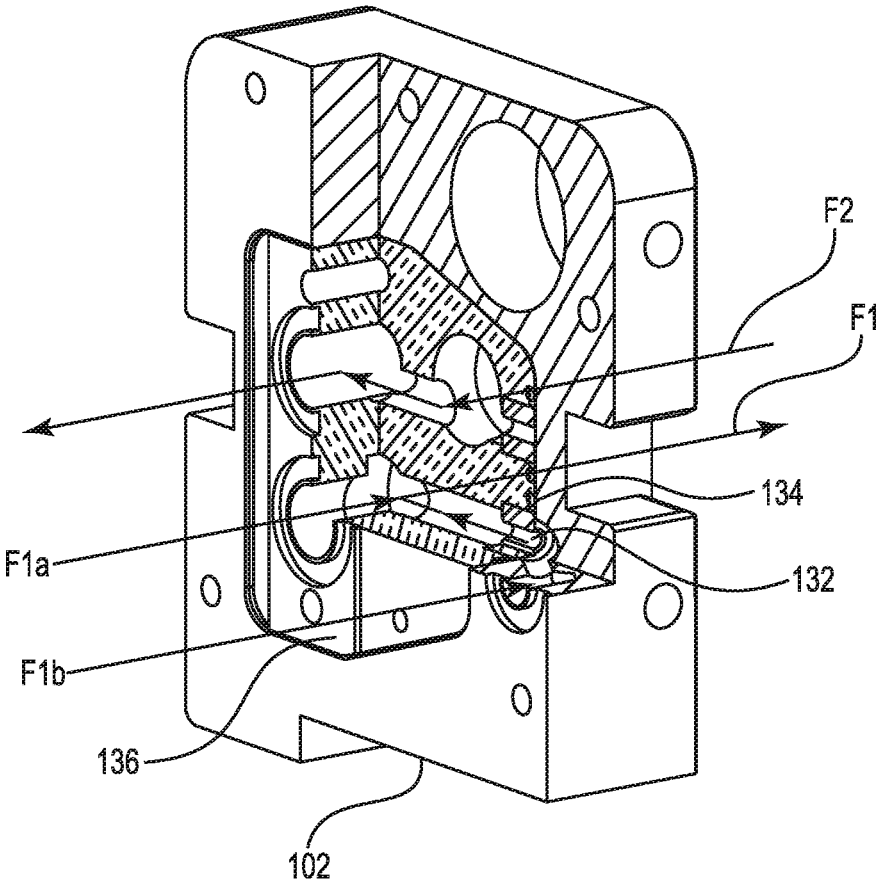
FIG. 3 is a perspective view of an end cap of an LED module with a partial cross-sectional portion according to certain embodiments.

An LED module is depicted in FIG. 1 generally at 100 and shown in cross section in FIG. 2. Details of an end cap assembly 102 of the module are shown in FIG. 3.

The LED module 100 generally comprises a reflector portion 104 and a side cover portion 106. A first end cap 102 is disposed on a first longitudinal end and a second end cap is disposed on an opposing second longitudinal end 108. The reflector 104 and side cover 106 portions span between the ends 102, 108 to form a longitudinal body 110. At least one of the end caps 102, 108 defines a fluid inlet 112 and fluid outlet 114. An electrical connection 116 for the LED package can also be defined on one of the end caps.

An LED package 118 is disposed within the interior space defined by the reflector 104 and side cover 106 portions. The LED package 118 is oriented so that the radiation or light projected in a horizontal direction by the LED package is reflected off of the inner curved surface 120 of the reflector portion 106, which is then redirected by that curved surface 120 vertically downwards towards a target surface.

A transparent cover 122 (e.g., glass, sapphire or plastic) can be provided in the optical opening between the reflector and side cover below the reflector inner surface 122 to seal the interior space of the LED module against contaminants.

The curvature of the inner surface of the reflector 120 can be shaped to focus the beam patterns of the light or radiation emitted by the LED package. A reflective surface can be formed directly on the inner surface 120, or an additional reflector component can be secured to the reflector portion's inner surface 120.

The LED package 118 can be cooled by thermally coupling the LED package to a heat exchanger 124. The heat exchanger can be configured as a water rail such as is shown in FIG. 2. The water rail includes a first 126 and second 128 fluid passages so that a coolant fluid can flow through the rail and remove heat.

The LED package, heat exchanger, reflector inner surface 120, reflector portion 104, side cover portion and window 122 each extend longitudinally between the first 102 and second 108 end caps. The light or radiation from the LED package projects laterally outward from the longitudinal body 110.

The reflector portion 104, side cover portion and heat exchanger 124 can be formed, for example, as aluminum extrusions because aluminum has advantageous thermal conductivity properties and is relatively easy to form as an extrusion.

The LED package can be configured, for example, as disclosed in U.S. Patent Publication No. 2013/0087722 A1, U.S. Patent Publication No. 2016/0037591 A1 and U.S. patent application Ser. No. 15/205,938, which are each hereby incorporated by reference herein in their entirety.

Referring to FIG. 2, a coolant passageway or channel 130 is formed through the longitudinal length of the reflector portion 104. This allows for heat absorbed into the reflector portion via the reflector surface 120 to be removed by flowing or circulating coolant fluid through the passageway 130.

The coolant passages can also be connected to a city water system so that water inbound to a building will flow through the LED module(s) as part of the water circuit for the building. This arrangement can be used to pre-heat water that is introduced to a water heater or hot water system.

The coolant fluid can be circulated away from the LED module to a heat exchanger or a chiller to remove the heat absorbed by the fluid before circulating back through the LED module 100. The coolant fluid can be virtually any fluid, including water, glycols, mixtures of water and polyethylene glycol or polypropylene glycol, and fluids such as coolants used as refrigerants in HVAC installations. The coolant can also include water with a biological treatment or passivation.

The fluid can be cooled, such as chilled water, and any number of additives can be added to the coolant fluid.

In one particular example implementation, a reflector portion was observed to be heated to a temperature of 240° F. when no coolant flow was provided to passage 130. However, when a coolant, such as water, was circulated through the passage 130, an operating temperature range of between 70° F. and 80° F. was attained.

In one example embodiment, the outer diameter dimension of the coolant passageway 130 is 5.6 mm, the reflector portion used was an aluminum alloy extrusion measuring 95 mm×55 mm, the reflector surface was polished metal; the LED package emitted UVA spectrum radiation; and the coolant water used was introduced at about 50° F. at a flow of slightly less than 2 gpm. In the absence of water flow to cool, the reflector extrusion attained a temperature of about 240° F. in about 30 minutes, but with coolant flow through the reflector coolant passage, the extrusion held a steady-state operating temperature in the range of 70° F. and 80° F.

Referring to FIG. 3, the first end cap 102 is shown. It should be noted that the second end cap 108 can be similarly configured, albeit in a mirrored arrangement. Thus, the configuration of the LED module utilizes common parts between the connection end (first end) and the crossover end (second end). For this reason, the insulator components are symmetrical about their respective horizontal axes. Orifices are used in passages of both sides even though only one is actually active. Moreover, the orifice bushing (discussed below) doubles as an internal gland ring for an adjacent O-ring to keep the O-ring from collapsing during assembly.

Flow of coolant through the end cap 102 can be in either direction. However, in the depicted example FIG. 3, the flow is indicated by the arrow F1 to show that flow F1*a* through the lower connection passageway 128 (passage closest to the window 122) through the water rail 124 combines coolant flow from the lower passageway 128 with the coolant flow F1*b* through the coolant passageway 130 in the reflector portion. These flows through the passageways then exit the end cap 102 via the fluid outlet 114. Fluid flow F2 into the LED module 100 is provided through the upper passageway 126 in the water rail 124, which does not mix with either of F1*a* or F1*b* flows within the end cap 102. The coolant flows through upper passageway 126 of the water rail 124 across the LED module 100 to the opposing (second) end cap, where the fluid is circulated from the outlet 114 to the inlet 112. Alternatively, the coolant flows into an adjacent module's inlet of a first end cap if more than one LED module is connected in series. As can be appreciated, the inlet 112 and outlet 114 designations are relative to the directional flow of the coolant therethrough.

In another alternative, the second end cap 108 has its respective inlet 112 and outlet 114 operated in reverse of the first end cap 102. In such arrangement, the flows indicated in FIG. 3 are reversed so that the inlet is now 114 and the outlet is 112. The flow F1 into the inlet 114 splits to flows F1*a* and F1*b* through both of the lower channel 128 in the water rail 124 and through the channel 130 in the reflector portion. The upper channel 126 of the water rail F2 flows coolant out of its respective port 112. This arrangement can be used, for example, when coolant is being introduced into each end cap simultaneously, rather than being merely crossed over at the second end cap. Situations where this configuration might be used include those where two or more LED modules are fluidically connected in series or where separate coolant flows are introduced to each respective end 102, 108 of the LED module 100 and coupled out of the opposing end without crossing over within the module body 110.

An orifice bushing 132 is disposed in the passageway from the inlet/outlet 114 to the fluid channel 130 in the reflector portion 104. A rubber O-ring 134 seals the interface of the bushing 132 against the inner surface of the end cap or block 102.

The orifice bushing 132 functions to restrict the flow of coolant to the reflector. The amount of restriction is selected to avoid starving the water rail 124 of coolant flow due to the fraction of coolant volume traveling through the reflector portion 104 being too large. The bushing 132 has a narrowed inner diameter as compared to the diameter of the coolant passage 130 through the reflector portion 104.

The channels in the end cap assembly 102 are formed as part of a floating end block 136 that is disposed in a cavity defined in the end cap 102. The block is preferably formed of an electrical and/or thermally insulating material whereas the end cap 102 is formed of an electrically and thermally conductive metal such as aluminum. The insulating block floats within the cavity to keep coolant leaks from arising due to thermal expansion and retraction during operation.

Alternatively, the second end cap can be formed as a crossover end cap where the coolant fluids from the passage 130 and 126 are simply circulated back through a return passage, such as the second fluid passage 128 in the water rail 124.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A light emitting diode (LED) module, comprising:

a first end cap;

a second end cap;

a reflector portion extending longitudinally between the first end cap and the second end cap, the reflector portion including an internal coolant passageway defined longitudinally through the reflector portion and fluidically coupled through the first end cap and through the second end cap; and an LED package disposed adjacent to the reflector portion wherein the first end cap comprises:

a first fluid passageway;

a second fluid passageway; and a third fluid passageway coupled to the internal coolant passageway defined longitudinally through the reflector portion;

wherein the third fluid passageway communicates with the second fluid passageway and not the first fluid passageway.

2. The LED module of claim 1, wherein the reflector portion includes an inner curved surface oriented to reflect radiation emitted by the LED package so that the radiation exits the LED module laterally from the LED module between the first and second end caps.

3. The LED module of claim 1, further comprising a side cover portion coupled to the reflector portion to define an enclosure having an interior and a longitudinal opening spanning laterally between a portion of the reflector portion and a portion of the side cover portion, wherein a transparent cover portion is disposed in the longitudinal opening to form a sealed enclosure, and wherein the LED package is disposed entirely within the enclosure.

4. The LED module of claim 1, further comprising a heat exchanger thermally coupled to the LED package and extending longitudinally between the first and second end caps, the heat exchanger including at least one coolant passageway defined through a longitudinal length of the heat exchanger and coupled through each of the first and second end caps.

5. The LED module of claim 1, wherein the first end cap further comprises:

an orifice bushing disposed within the third fluid passageway to define a narrowed inner diameter portion of the third fluid passageway.

6. The LED module of claim 5, wherein the first, second and third fluid passageways are defined within an insulated block arranged to float within a cavity defined in the first end cap.

7. The LED module of claim 6, wherein an O-ring is disposed between the orifice bushing and a sidewall of the cavity defined in the first end cap.

8. The LED module of claim 1, wherein the second end cap has a mirror image configuration about an axis normal to the longitudinal length of the reflector portion as compared to the first end cap.

9. An end cap for a liquid cooled LED module including a reflector portion elongated in a longitudinal direction, the reflector portion including an internal coolant passageway defined longitudinally through the reflector portion and fluidically coupled through the end cap, and an LED package disposed adjacent to the reflector portion, the end cap comprising:

a first fluid passageway;

a second fluid passageway;

a third fluid passageway coupled to the internal coolant passageway defined longitudinally through the reflector portion; and an orifice bushing disposed within the third fluid passageway to define a narrowed inner diameter portion of the third fluid passageway, wherein the third fluid passageway communicates with the second fluid passageway and not the first fluid passageway.

10. The end cap of claim 9, wherein the first, second and third fluid passageways are defined within an insulated block arranged to float within a cavity defined in the first end cap.

11. The end cap of claim 10, wherein an O-ring is disposed between the orifice bushing and a sidewall of the cavity defined in the first end cap.

12. The end cap of claim 9, further comprising:

a coolant inlet extending longitudinally from the end cap and communicating with the first fluid passage, and not communicating with the second fluid passage and the third fluid passage; and a coolant outlet extending longitudinally from the end cap and communicating with the second fluid passage and the third fluid passage, and not communicating with the first fluid passage.

13. A method of cooling an LED package disposed in an LED module, the method comprising:

circulating a coolant through an internal passageway defined within a reflector portion of the LED module and through an end cap coupled to the reflector portion, wherein the end cap comprises a first fluid passageway, a second fluid passageway and a third fluid passageway, the third fluid passageway coupled to the internal passageway defined within the reflector portion, and wherein the third fluid passageway communicates with the second fluid passageway and not the first fluid passageway;

circulating the coolant fluid through the end cap and through a first passageway defined within a heat exchanger thermally coupled to the LED package; and restricting the flow of coolant circulating through the internal passageway defined within the reflector portion of the LED module to prevent starving of the flow of coolant circulating through the first passageway defined within the heat exchanger.

14. The method of claim 13, wherein the step of restricting includes disposing an orifice bushing within a passageway defined in an end cap.

15. The method of claim 13, further comprising:

circulating the coolant fluid through a second passageway defined within a heat exchanger thermally coupled to the LED package in an opposite direction as the circulation of the coolant fluid through the passageway defined within a reflector portion of the LED module.

16. The method of claim 15, further comprising:

combining the fluid circulating through the passageway defined within the reflector portion of the LED module with the coolant fluid circulating through the first passageway defined within the heat exchanger; and isolating the coolant fluid circulating through a first passageway defined within a exchanger from the fluid circulating through the passageway defined within the reflector portion of the LED module and from the coolant fluid circulating through the first passageway defined within the heat exchanger.

17. The method of claim 13, wherein the coolant fluid includes water.

18. The method of claim 13, further comprising:

disposing an insulating block within a cavity formed within the end cap such that the insulating block floats within the cavity, wherein the first, second and third fluid passageways are defined within an insulated block.

19. The method of claim 18, further comprising:

disposing an O-ring between the insulating block and an inner wall of the cavity formed in the end cap.

20. The method of claim 13, further comprising:

lowering a steady state operating temperature of a reflector portion of the LED module to be within a range of 70°F. and 80°F.

* * * * *